US008706017B2

(12) United States Patent
Mizes

(10) Patent No.: US 8,706,017 B2
(45) Date of Patent: Apr. 22, 2014

(54) DUPLEX WEB PRINTER SYSTEM REGISTRATION TECHNIQUE

(75) Inventor: Howard A Mizes, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 968 days.

(21) Appl. No.: 12/491,290

(22) Filed: Jun. 25, 2009

(65) Prior Publication Data

US 2010/0329756 A1 Dec. 30, 2010

(51) Int. Cl.

| | |
|---|---|
| ***G03G 15/00*** | (2006.01) |
| ***B41J 2/01*** | (2006.01) |
| ***B41J 29/38*** | (2006.01) |
| ***B41J 29/393*** | (2006.01) |

(52) U.S. Cl.
USPC ..... 399/364; 347/1; 347/171

(58) Field of Classification Search
USPC ..... 347/12, 13, 19
See application file for complete search history.

(56) References Cited

U.S. PATENT DOCUMENTS

| | | | | |
|---|---|---|---|---|
| 4,619,278 | A * | 10/1986 | Smeed et al. | 131/284 |
| 6,118,950 | A * | 9/2000 | Wibbels et al. | 399/16 |
| 7,216,952 | B2 * | 5/2007 | Claramunt et al. | 347/19 |
| 7,967,517 | B2 * | 6/2011 | Wada | 400/621 |
| 2004/0136733 | A1 * | 7/2004 | Kretschmann et al. | 399/16 |
| 2004/0160468 | A1 * | 8/2004 | Kim et al. | 347/12 |
| 2005/0183603 | A1 * | 8/2005 | Trelewicz et al. | 101/484 |
| 2005/0276649 | A1 * | 12/2005 | Min | 400/120.16 |
| 2006/0023057 | A1 * | 2/2006 | Jung | 347/179 |
| 2007/0175351 | A1 * | 8/2007 | Boness | 101/485 |
| 2007/0213215 | A1 * | 9/2007 | Dashiell et al. | 503/226 |
| 2007/0222805 | A1 * | 9/2007 | Moscato et al. | 347/12 |
| 2008/0278757 | A1 * | 11/2008 | Wong | 358/1.18 |
| 2010/0091334 | A1 * | 4/2010 | Qiao et al. | 358/3.26 |
| 2010/0201774 | A1 * | 8/2010 | Motojima | 347/104 |
| 2010/0230527 | A1 * | 9/2010 | Ray | 242/538.1 |
| 2010/0315461 | A1 * | 12/2010 | Mongeon et al. | 347/19 |

FOREIGN PATENT DOCUMENTS

| | | | | |
|---|---|---|---|---|
| JP | 2001058446 | A * | 3/2001 | B41J 29/46 |

OTHER PUBLICATIONS

Machine Translation of JP 2001058446 A, JPO, Jan. 21, 2012.*
U.S. Appl. No. 12/175,879, filed Jul. 18, 2008, by Howard A. Mizes et al, and entitled Continuous Web Printing System Alignment Method.
U.S. Appl. No. 12/372,294, filed Feb. 17, 2009, by Howard A. Mizes et al, and entitled System and Method for Cross-Process Control of Continuous Web Printing System.

* cited by examiner

*Primary Examiner* — Nguyen Ha

(57) ABSTRACT

A system and method for achieving registering of side 1 and side 2 images includes sensing marks on both sides of a web with a single IOWA sensor and relying on light transmission through paper to sense side 1 marks. Side 1, the side not facing the IOWA sensor utilizes increased contrast (black toner), mark width, and repeats in order to make effective image "show through." The image of the marks on both sides of the sheet is compared with respect to each other and adjustments to some combination of position, timing, and image magnification are made as required.

20 Claims, 8 Drawing Sheets

A

B

DUPLEX WEB PRINTER SYSTEM REGISTRATION TECHNIQUE

The system and method disclosed herein relates to printing systems that generate images onto continuous web substrates. In particular, the disclosed embodiment relates to duplex registration of side 1 and side 2 images.

Printers provide fast, reliable, and automatic reproduction of images. The word "printer" as used herein encompasses any apparatus, such as a digital copier, book marking machine, facsimile machine, multi-function machine, etc., which performs a print outputting function for any purpose. Printing features that may be implemented in printers include the ability to do either full color or black and white printing, and printing onto one (simplex) or both sides of the image substrate (duplex).

Some printers, especially those designed for very high speed or high volume printing, produce images on a continuous web print substrate. In these printers, the image substrate material is typically supplied from large, heavy rolls of paper upon which an image is printed instead of feeding pre-cut sheets from a bin. The paper mill rolls can typically be provided at a lower cost per printed page than pre-cut sheets. Each such roll provides a very large (very long) supply of paper printing substrate in a defined width. Fan-fold or computer form web substrates may be used in some printers having feeders that engage sprocket holes in the edges of the substrate.

Typically, with web roll feeding, the web is fed off the roll past one or more print head assemblies that eject ink onto the web, and then through one or more stations that fix the image to the web. A print head is a structure including a set of ejectors arranged in at least one linear array of ejectors, for placing marks on media according to digital data applied thereto. Print heads may be used with different kinds of ink-jet technologies, such as liquid ink jet, phase-change ink, systems that eject solid particles onto the media, etc.

Thereafter, the web may be cut in a chopper and/or slitter to form copy sheets. Alternatively, the printed web output can be rewound onto an output roll (uncut) for further processing offline. In addition to cost advantages, web printers can also have advantages in feeding reliability, i.e., lower misfeed and jam rates within the printer as compared to high speed feeding of precut sheets through a printing apparatus.

A further advantage is that web feeding from large rolls requires less downtime for paper loading. For example, a system printing onto web paper supplied from a 5 foot diameter supply roll is typically able to print continuously for an entire shift without requiring any operator action. Printers using sheets may require an operator to re-load cut sheet feeders 2 to 3 times per hour. Continuous web printing also provides greater productivity for the same printer processing speed and corresponding paper or process path velocity through the printer, since web printing does not require pitch space skips between images as is required between each sheet for cut sheet printing.

A requirement of continuous feed duplex printing is registration of the side 1 image to the side 2 image. A standard technique to perform this registration is to sense registration marks on preprinted forms. A sensor detects these marks and uses the timing to maintain a fixed spacing between the registration mark and the printed page. A solid ink direct marking continuous feed printer presents a unique situation and the standard approach may not work because the paper is heated in the print zone which causes lateral size paper shrinkage between side 1 and side 2. A single registration mark cannot monitor the magnitude of paper shrinkage throughout the duplex paper path which is required for registration across all colors. The long print zone can give rise to drift of the paper in the lateral direction so cross process side 1 to side 2 registration must also be maintained.

Accordingly, in answer to the above-mentioned problem, a system and method is disclosed for achieving registering of side 1 and side 2 images by sensing marks on both sides of a web with a single IOWA sensor and relying on light transmission through paper. The side not facing the IOWA sensor utilizes increased contrast (black toner), mark width, and repeats to increase the detectability of the back side test target. The registration of the marks on both sides of the sheet are compared with respect to each other and adjustments to some combination of position, timing, and image magnification are made.

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

Figure 10:
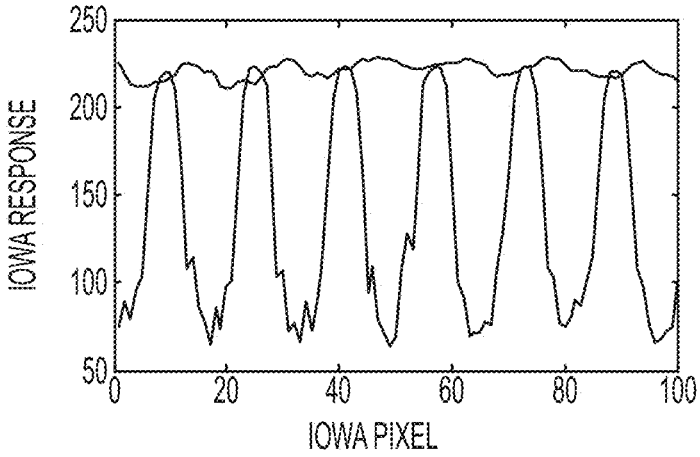
Figure 11:
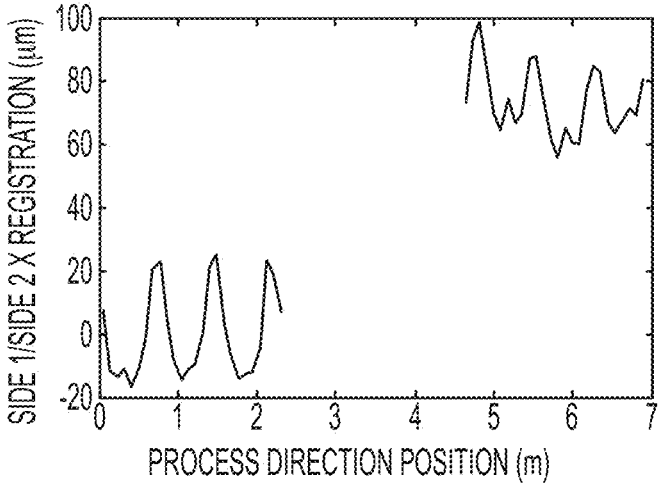

FIG. 10 is a plot in the lower portion of the figure showing the profile through 5 side 1 dashes and in an upper portion 5 side 2 dashes; and FIG. 11 is a plot showing variation in side 1 and side 2 lateral alignment.

Figure 1:
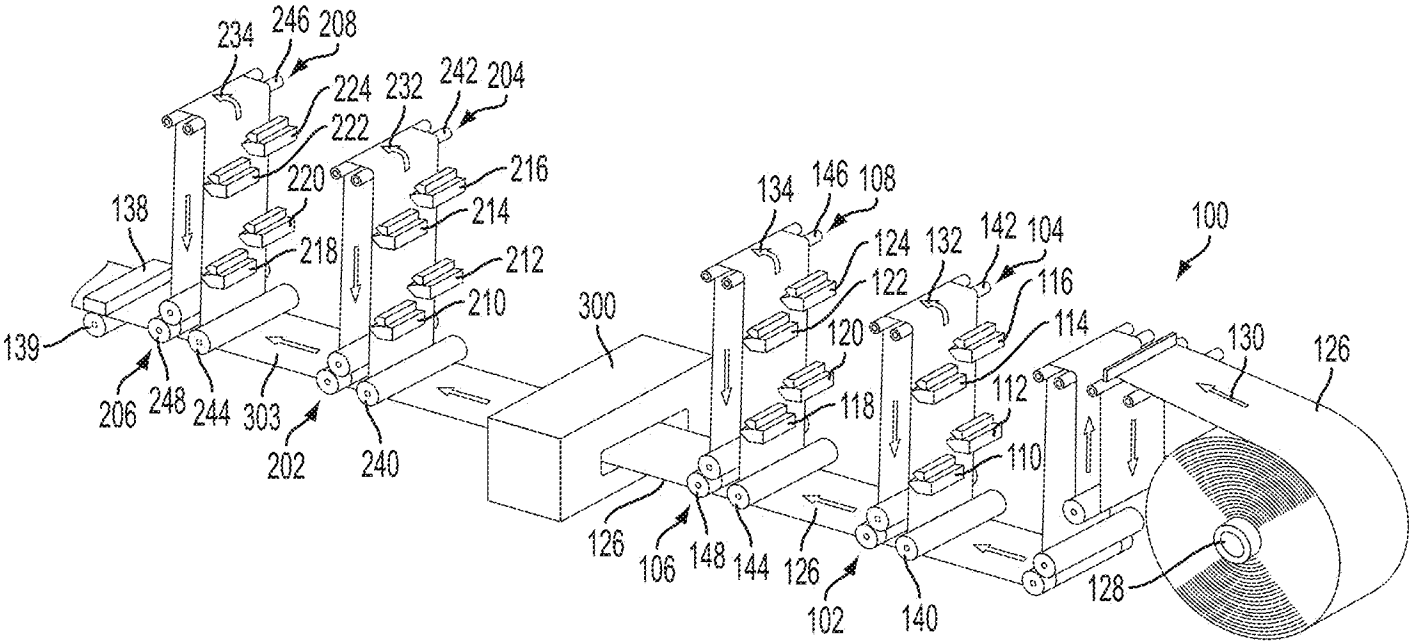
FIG. 1 depicts a partial perspective view of a continuous web tandem printing system with eight print stations.

With initial reference to FIG. 1, a continuous web printer system 100 includes four print stations 102, 104, 106, and 108. The print station 102 includes print heads 110 and 112, the print station 104 includes print heads 114 and 116, the print station 106 includes print heads 118 and 120, and the print station 108 includes print heads 122 and 124. A web of print media 126 is positioned on a spindle 128 to provide media for the continuous web printer system 100. The print media 126 is fed along a process path 130 indicated by a series of arrows.

The process path 130, which is the actual path along which the media 126 proceeds, includes process path segment 132 which is located adjacent to the print stations 102 and 104, and process path segment 134 which is located adjacent to the print stations 106 and 108. The process path segment 132 is defined by rollers 140 and 142 while the process path segment 134 is defined by rollers 144 and 146. A roller 148 defines a horizontal turn in the process path. Alignment of the print stations 102, 104, 106, and 108 with the respective process path segment 132 or 134 is controlled by an alignment control system such as disclosed in U.S. patent application Ser. No. 12/175,879, filed Jul. 18, 2008, by Howard A. Mizes et al, and entitled CONTINUOUS WEB PRINTING SYSTEM ALIGNMENT METHOD and U.S. patent application Ser. No. 12/372,294, filed Feb. 17, 2009, by Howard A. Mizes et al, and entitled SYSTEM AND METHOD FOR CROSS-PROCESS CONTROL OF CONTINUOUS WEB PRINTING SYSTEM, both of which are included herein by reference to the extent necessary to practice the present disclosure.

Figure 2A:
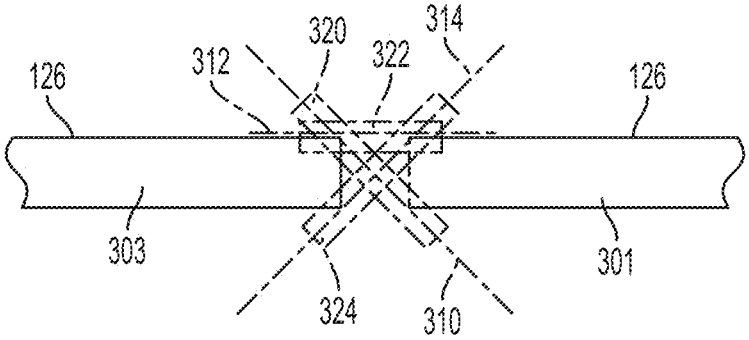
FIGS. 2A and 2B are, respectively, top and perspective, schematic, illustrations depicting a method of inverting a continuous substrate for duplexing purposes.
Figure 2B:
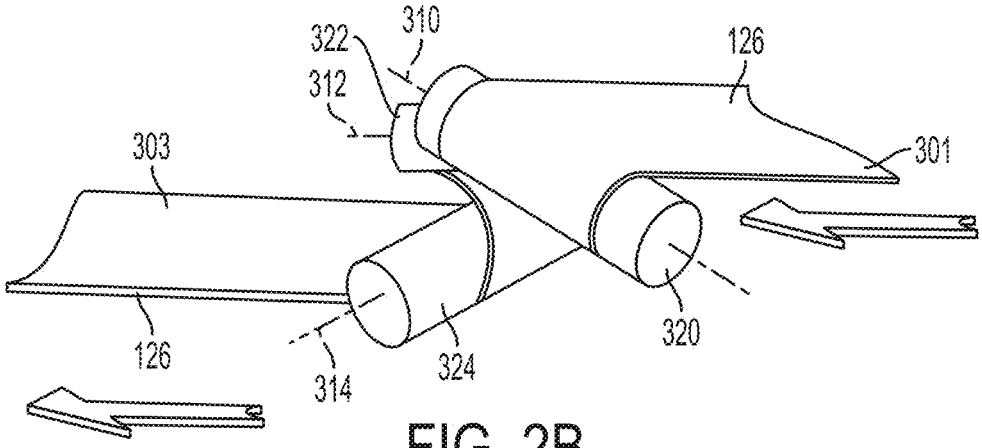

In order to accomplish duplexing on continuous web 126, the web is directed into an inverter mechanism 300 which turns the web over for printing on the opposite side of side 2. Inverter mechanism 300 turns web 126 over as shown in FIGS. 2A and 2B where continuous web 126 is folded three times, about three respective axes. For example, continuous web 126 may be folded with a first surface 301, first about a 45° axis 310 and then about an axis 312 parallel to the advance of continuous web 126 and, finally, about another 45° axis 314. It should be appreciated that such triple folding of continuous web 126 by inverter 300 results in an inverted web surface whose direction of motion is generally parallel to the original direction but has a second surface 303 at its top surface. Folding at the above specified axes is preferably performed by providing elongated rollers 320, 322 and 324, having preselected diameters, along axes 310, 312 and 314, respectively. To prevent damage to the continuous web 126, rollers 320, 322 and 324 are preferably appropriately separated, as shown schematically in FIG. 2B, such that substrate 126 is folded by less than 180° at each axis.

With further reference to FIG. 1, downstream of inverter 300 is a second or tandem marking engine that functions identically as the previously describe marking engine. The now inverter continuous web with an inverted surface 226 on top is directed into the second print engine that includes four print stations 202, 204, 206, and 208 to receive an image of side 2 of the continuous web. The print station 202 includes print heads 210 and 212, the print station 204 includes print heads 214 and 216, the print station 206 includes print heads 218 and 220, and the print station 208 includes print heads 222 and 224. The print media 126 is fed along a process path 230 indicated by a series of arrows.

The process path 230, which is the actual path along which the media 126 proceeds, includes process path segment 232 which is located adjacent to the print stations 202 and 204, and process path segment 234 which is located adjacent to the print stations 206 and 208. The process path segment 232 is defined by rollers 240 and 242 while the process path segment 234 is defined by rollers 244 and 246. A roller 248 directs the web 126 under an image on web array sensor (IOWA) 138 that is held steady by a backer roll 139. The IOWA sensor 138 is a full width image contact sensor, which monitors the ink on the web 126 as the web passes under the IOWA sensor. When there is ink on the web 126, the light reflection off of the web 126 is low and when there is no ink on the web 126, the amount of reflected light is high. When a pattern of ink is printed by one or more of the heretofore-mentioned print heads, the IOWA sensor 138 may be used to sense the printed mark and provide a sensor output to a control device, such as, a computer for processing. The paper passes through another series of rolls and stations that condition the image before it is taken up by a rewinder or processed by other finishing equipment.

Ink jet printing systems as described above consist of a series of individual print heads jetting ink of different colors and located at different positions along the print path. If these heads are not perfectly aligned in the lateral position there may be gaps or overlap at the transitions between the last jet on one print head and the first jet on the adjacent print head. If the timing of firing the jets is not coordinated with the web velocity and the spacing between the print heads along the print path, there will be a process direction misregistration between colors or at the transition between print heads.

Heretofore, simplex registration has been maintained by printing a test pattern of dashes from individual heads. The dashes are imaged with the IOWA sensor and the lateral and process direction position of each dash is calculated from the image. Because the nozzle which produces each dash is known, the position of every print head can be inferred from the test pattern. The measured locations of the heads are compared to the desired location of the heads. The heads are physically moved by motors in the lateral direction and the timing of the firing in the process direction. In this way registration is maintained.

Figure 3:
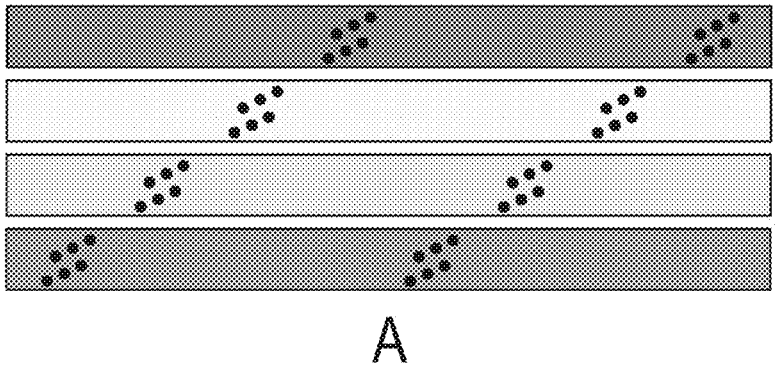
FIG. 3 shows a test pattern where FIGS. 3A and 3B, respectively, show four print heads in sequence and a test pattern printed from that to measure registration.
Figure 3:
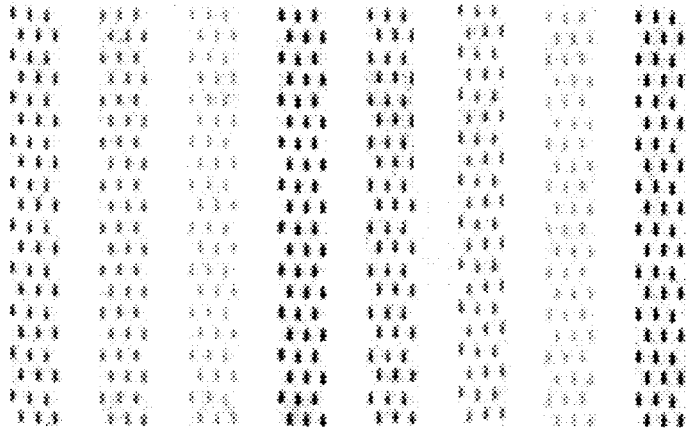

FIG. 3 shows a test pattern that is used to maintain registration. In FIG. 3A, four heads are shown in series along a print path. The black circles on each print head show the nozzles that are used to print the test pattern. FIG. 3B shows a captured IOWA image of the test pattern. A series of dashes are printed from each nozzle used in the test pattern. The center of each dash in the lateral direction is used to calculate the position of each nozzle. From the position of each nozzle, the position of the head is inferred. The bottom edge of each dash is used to calculate the process position of each head. These dashes have high contrast when printed on the side of the paper facing the IOWA sensor. However, they are not clearly resolved when the paper is flipped over and the show through image is measured.

In answer to this problem and in accordance with the present disclosure, an improved method and apparatus is disclosed that includes a modification of the registration pattern that is easily detected using a show through image. The show through image will be very faint, so there are three changes in the test pattern that can be used to increase the signal: (1) increased contrast because registration for each side is maintained separately, only one of the print heads in series is needed to determine the side 1 or side 2 registration. The high contrast black print head can be chosen for the show through test pattern; (2) increased width because a single pixel wide dash will give a weak show through signal, neighboring nozzles can be used to create a wider dash; and (3) a repeated signal because since the show through is weak, it can be difficult to distinguish a show through signal from variations in the reflectance of the web material. This problem is exacerbated from thick stock. However, if the dash pattern is repeated as in a ladder chart, the periodic pattern will be more easily detected in spite of the paper structure.

The IOWA backer roll 139 is typically white or a highly reflective surface. This requirement makes the IOWA signal insensitive to natural variations in the paper thickness due the structure of the paper fibers. This insensitivity is required for the IOWA sensor to robustly detect missing jets and to adjust print head uniformity. The white backer roll 139 also meets the requirements for side 1 or side 2 detection. When black ink is imaged on the other side of the paper, it prevents light that transmits through the paper to be reflected by the backer roll and is thus the source of the show through signal.

Figure 4:
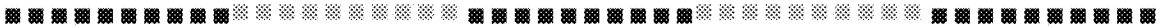
FIG. 4 is a plan view of one potential side 1 to side 2 registration pattern.

FIG. 4 shows one example of a test pattern that can be used for side 1 to side 2 alignment. The dark squares represent the dashes printed on side 2 of the image, those that are facing up and imaged by the IOWA sensor 138. The gray squares represent the dashes printed on side 1 of the image, those that are facing backer roll 139 and thus are imaged through the paper. The test pattern was chosen so that the transition between the side 1 and side 2 image would be continuous if both sides are aligned. The example shown in FIG. 4 illustrates a small misregistration between side 1 and side 2 in both the process and lateral direction.

It should be understood that variations of this pattern that are more robust against larger misregistrations or can measure changes in registration across the lateral direction can also be used.

Figure 5:
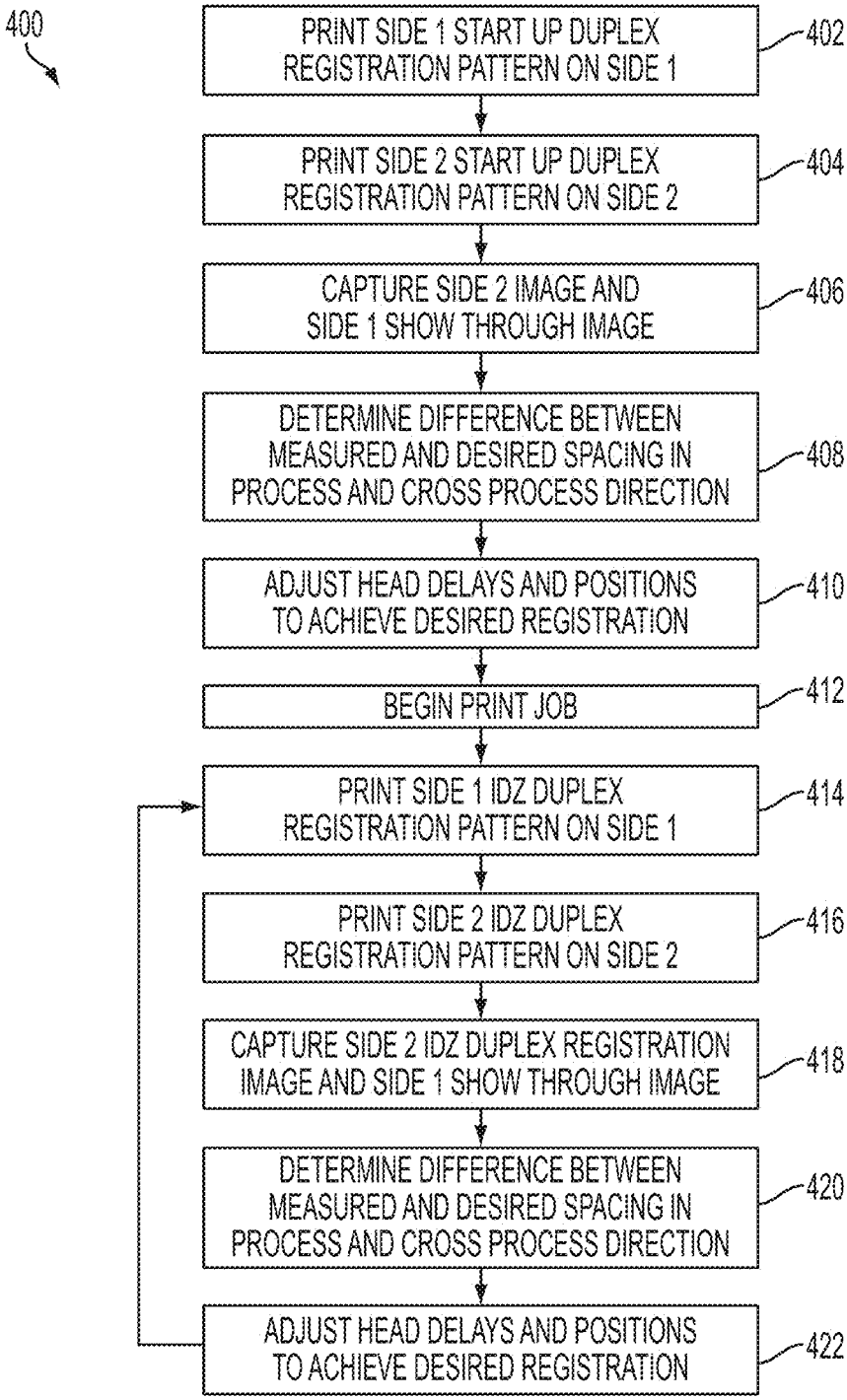
FIG. 5 is a flow chart of setting and maintaining side 1 to side 2 registration.

FIG. 5 is a flow chart 400 describing one embodiment of the present alignment method. In this description, side 1 refers to the first side printed and side 2 refers to the second side printed. Before printing of the customer images occurs, an initial alignment is made. First, in block 402, the side 1 start up duplex registration pattern is printed on side 1 when the paper passes through the first marking engine in FIG. 1 or, alternatively, takes its first pass through a marking engine in a Mobius configuration. In a Mobius configuration a roll of paper with a width of less than half the width of the marker leaves the unwinder from the right side of an engine positioned as in FIG. 1. The paper passes through a sequence of color markers in the print zone and an image or a test pattern is written on the paper. The paper then leaves the marking engine and passes through a series of rolls (not shown) where it is flipped, passes around the engine, and then reenters the marking engine from the side facing the rewinder parallel to its first pass through the print zone. In this way, the other side of the paper is imaged by different markers in the same marking engine. The paper leaves the marking engine a second time. It passes under a full width array sensor and is held steady by a backer roll. The paper passes through another series of rolls and stations that condition the image before it is taken up by a rewinder or processed by other finishing equipment. Next, in block 404, the side 2 start up duplex registration pattern is printed on side 2 when the paper passes through the second marking engine in FIG. 1 or takes its second pass through the marking engine in Mobius configuration. The side 2 start up pattern is printed in the vicinity of the previously printed side 1 image. The test pattern passes under IOWA sensor 138 and the side 2 pattern and the show through side 1 test pattern is captured in block 406. The image is processed and the spacing between the side 2 and side 1 dashes are determined. The difference between the measured spacing and the desired spacing is determined in block 408. This difference is used in block 410 to adjust head delays, move print heads, and adjust the image magnification to achieve side 1 to side 2 registration at the start of the print job.

The print job then begins in block 412. At regular intervals, as shown in block 414, a side 1 interdocument zone (IDZ) duplex registration pattern is printed in the cutting zone between two images when the paper passes through the first marking engine or takes its first pass through the marking engine in Mobius configuration. In block 416, when this IDZ arrives in the next marking engine or in its second pass through the marking engine in Mobius configuration, the side 2 IDZ duplex registration pattern is printed on side 2. The IDZ duplex registration pattern is then captured in block 418 when it arrives at the IOWA sensor 138. The image is processed and the measured spacing between the side 1 dashes and the side 2 dashes is determined in block 420. If the spacing is different, then in block 422 the head delays are adjusted, the heads are moved, and the image magnification is changed.

Figure 6:
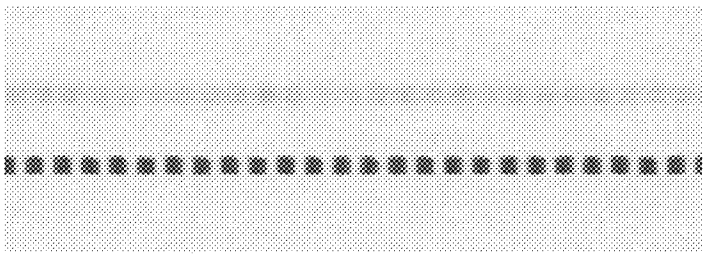
FIG. 6 is a plan view of a captured full width array sensor image of a side 2 and side 1 show through duplex alignment pattern.

Tests have shown that the show through signal is strong enough to measure the side 1 and side 2 registration to the accuracy required as depicted in a section of a captured image in FIG. 6 using a conventional IOWA sensor and a white backer roll. A ladder chart of 8 pixels ON and 8 pixels OFF printed while a web was strung in a Mobius configuration. The resolution of the image is 600 spi in the lateral direction and 430 spi in the process direction. The image was captured at a resolution of 600 spi in the lateral direction and 215 spi in the process direction. The size of the image in FIG. 6 is approximately ⅔" in both the lateral and process direction.

The side 2 ladder chart, which is facing the sensor, is clearly resolved. However, the side 1 dashes from the first pass through the sensor is also seen in the test pattern. The contrast however is much lower and in some locations it is difficult to resolve the individual dashes.

Figure 7:
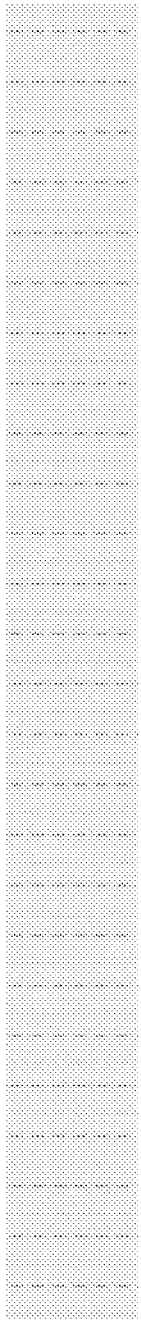
FIG. 7 shows a ladder chart with an interlace of side 1 and side 2 patterns.

To test the ability of the image processing algorithms to accurately measure the side 1 to side 2 registration, this image was printed multiple times throughout a long job. The image was printed on 75 gsm stock. The registration between side 1 and side 2 was intentionally not maintained in order to produce a variation in side 1 to side 2 registration, as shown in FIG. 7.

Figure 8:
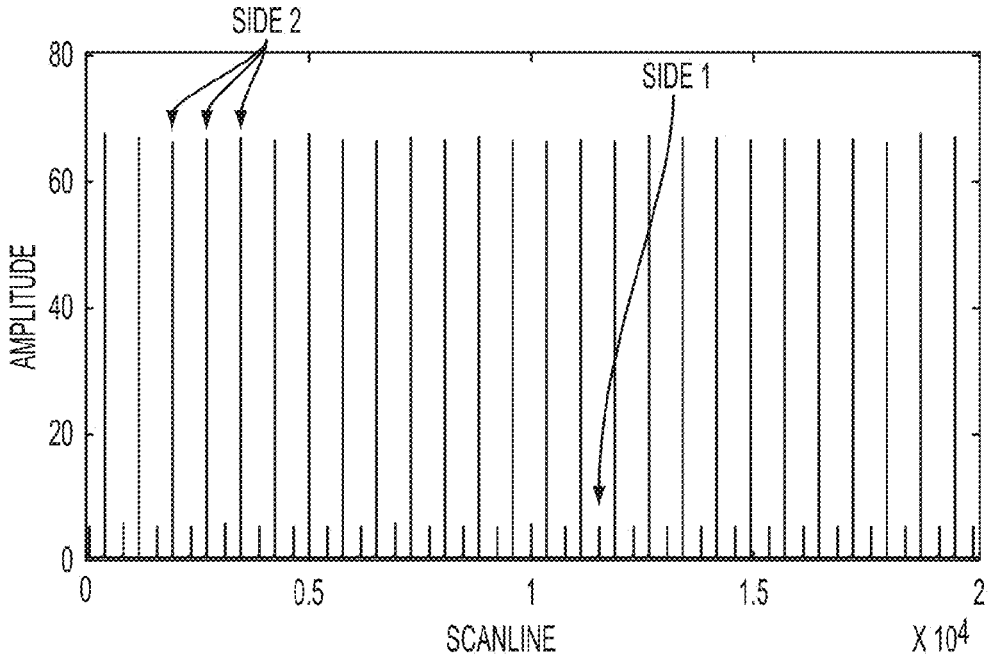
FIG. 8 is a plot of amplitude of the signal in FIG. 7 as a function of the scanline.

The process direction position of the side 1 and side 2 ladder chart was determined by measuring the amplitude of a signal at the known period of the ladder chart for each scanline in the image. This signal is large over a side 2 ladder chart, moderate over the show through of the side 1 ladder chart, and small over a blank section of paper. A plot of the amplitude of this signal as a function of scanline is shown in FIG. 8. The large tics with an amplitude of approximately 65 IOWA response units are from the side 2 pattern facing the IOWA sensor. The small tics with an amplitude of approximately 5 IOWA response units are from the side 1 show through pattern facing away from the IOWA sensor. The random paper structure gives a signal of approximately 0.2 IOWA response units. This large signal to noise ration for the show though indicates that the technique should work for even thicker stocks and coated paper where the show through signal will be smaller.

Figure 9:
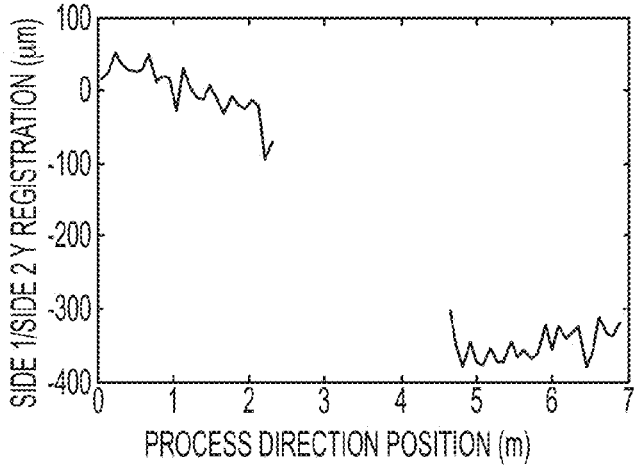
FIG. 9 is a plot showing variation is side 1 and side 2 process direction alignment.

The variation in the process direction position was measured by detecting the edges of adjacent tics of FIG. 8 and determining the difference as a function of process direction position. The variation about the mean position is plotted in the figure. Two images were captured in sequence and they are both shown in FIG. 9. One observes that the spacing between the side 1 and side 2 image can be measured with precision better than approximately 10 microns. This is much better than typical side 1 to side 2 alignment requirements which are on the order of a couple 100 microns.

To calculate the lateral alignment, the profile of both the side 1 and side 2 dashes were obtained. FIG. 10 shows a profile through 6 of the test pattern dashes. The line starting at about 60 IOWA response units plots the side 2 profile and the line starting at about 225 IPWA units plots the show through side 1 profile. The centers of the side 2 dashes can be easily measured, but the centers are the side 1 dashes are confounded with a variation in the signal due to paper thickness variations and backer roll reflectance variations. However, the phase of the periodic signal can be accurately measured in the presence of these noises. The difference in the phases of these two signals is proportional to the lateral misregistration.

In FIG. 11, a plot shows the lateral misregistration as a function of process direction position as measured from this test pattern. The accuracy of the measurement appears to be on the order of 1 to 2 microns. This is much better than the typical side 1 to side 2 alignment requirements which are on the order of a couple 100 microns.

It should not be known that a method and apparatus has been disclosed for maintaining side 1 and side 2 registration for duplex continuous web printing that uses a single full width array sensor for side 1 to side 2 registration to sense marks on both sides of the web and relying on light transmission through paper. The side not facing the full width array utilizes increased contrast, mark width and repeats so as to make effective image show through. The image of marks on both sides of the paper are compared with respect to each other and adjustments to some combination of position, timing, and image magnification are made as required. Thus, a cost and space advantage is obtained by eliminating a second side array sensor.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A method of maintaining side 1 to side 2 registration during duplex imaging on paper in an ink jet printing system, comprising:

printing a side 1 start up duplex registration pattern in ink on side 1 of said paper;

printing a side 2 start up duplex registration pattern in ink on side 2 of said paper;

providing a single full width image on web array sensor;

capturing a side 2 image and a side 1 show through image with said full width image on web array sensor;

determining difference between measured and desired spacing in process and cross process directions in response to signals from said full width image on web array sensor;

adjusting head delays and positions to achieve desired registration;

beginning a print job;

printing side 1 inter-document zone duplex registration pattern on side 1;

printing side 2 inter-document zone duplex registration pattern on side 2;

capturing side 2 inter-document zone duplex registration image and side 1 show through image;

determining difference between measured and desired spacing in process and cross process directions in response to signals from said full width image on web array sensor;

adjusting head delays and positions to maintain desired registration, and repeating said registration pattern and determining the difference between measured and desired spacing in process and cross process directions and making appropriate head delays and position adjustments during said print job to maintain desired registration.

2. The method of claim 1, including providing said side 1 and side 2 images in ladder chart configuration.

3. The method of claim 1, wherein said printing system includes multiple print engines.

4. The method of claim 1, wherein said printing system includes continuous web feeding.

5. The method of claim 1, wherein said printing system includes a single print engine.

6. The method of claim 5, wherein said printing system includes continuous web feeding.

7. The method of claim 6, wherein said single full width image on web array sensor senses marks on said continuous web with a first portion thereof on a first pass image and a second portion thereof on a second pass image.

8. The method of claim 7, wherein said full width image on web array sensor relies on light transmission through said continuous web to sense side 1 marks on said continuous web.

9. The method of claim 4, including increasing the efficiency of said full width image on web array in measuring show through of side 1 patterns by increasing contrast and mark width by a predetermined amount and repeating the patterns by a predetermined number.

10. The method of claim 9, wherein said full width array image on web sensor relies on light transmission through said continuous web to sense a side 1 pattern on said continuous web.

11. A continuous web feeding printer includes a system for maintaining side 1 to side 2 registration during duplex imaging of paper, comprising:

a predetermined paper path defined by a plurality of rollers;

at least one print engine for applying side 1 and side 2 images on opposite sides of said paper continuous web;

an inverter mechanism adapted to receive a side 1 image face-up on a surface of said continuous web from said print engine, turn said continuous web over such that said side 1 image is face-down on said continuous web and feed said continuous web in a direction to receive a side 2 image face-up thereon; and a single image on web full width image array sensor positioned downstream of said inverter mechanism for sensing senses multiple different patterns of ladder chart configured marks on said side 1 and side 2 images on said continuous web such that said multiple different patterns of ladder chart configured marks on said side 1 image on said continuous web are sensed through said continuous web to determine difference between said multiple different patterns of ladder chart configured marks on said side 1 and side 2 images.

12. The continuous web feeding printer of claim 11, wherein said full width image on web array sensor senses marks on said side 1 and side 2 images simultaneously.

13. The continuous web feeding printer of claim 11, wherein said full width image on web array sensor senses marks on said continuous web with a first portion thereof on said face-up image and a second portion thereof on said face-down image.

14. The continuous web feeding printer of claim 13, wherein said full width image on web array sensor senses light transmission through said continuous web to sense side 1 marks on said continuous web.

15. The continuous web feeding printer of claim 14, wherein the efficiency of said full width image on web array in measuring show through marks of said side 1 image is increased by increasing contrast of said marks and mark width by a predetermined amount beyond accepted standards and repeating said marks a predetermined number of times.

16. The continuous web feeding printer of claim 15, wherein said inverter mechanism includes at least three elongated rollers positioned to fold said continuous web at least three times.

17. The continuous web feeding printer of claim 16, wherein said inverter mechanism folds said continuous web about three respective axes.

18. The continuous web feeding printer of claim 16, wherein said at least one print engine includes a series of print stations.

19. The continuous web feeding printer of claim 18, wherein each of said series of print stations includes at least two print heads.

20. A continuous web feeding printer includes a system for maintaining side 1 to side 2 registration during duplex imaging onto paper, comprising:

a predetermined paper path defined by a plurality of rollers;

at least one print engine for applying side 1 and side 2 images on opposite sides of said continuous web of paper;

an inverter mechanism adapted to receive a side 1 image face-up on a surface of said continuous web from said print engine, turn said continuous web over such that said side 1 image is face-down on said continuous web and feed said continuous web in a direction to receive a side 2 image face-up thereon; and an image on web full width image array sensor positioned downstream of said inverter mechanism for sensing senses multiple different patterns of marks on said side 1 and side 2 images on said continuous web such that said multiple different patterns marks on said side 1 image on said continuous web are sensed through said continuous web, and wherein signals from said full width image array sensor are used to determine difference between said multiple different patterns of marks on said side 1 and side 2 images on said continuous web.

* * * * *